US012528567B2

(12) United States Patent
Chen

(10) Patent No.: US 12,528,567 B2
(45) Date of Patent: Jan. 20, 2026

(54) SECOND STAGE REGULATOR

(71) Applicant: Chun Wei Chen, Taipei (TW)

(72) Inventor: Chun Wei Chen, Taipei (TW)

( * ) Notice: Subject to any disclaimer, the term of this patent is extended or adjusted under 35 U.S.C. 154(b) by 675 days.

(21) Appl. No.: 17/980,347

(22) Filed: Nov. 3, 2022

(65) Prior Publication Data

US 2023/0141069 A1 May 11, 2023

(30) Foreign Application Priority Data

Nov. 11, 2021 (TW) ..... 110213297

(51) Int. Cl.
*B63C 11/22* (2006.01)

(52) U.S. Cl.
CPC ..... *B63C 11/2227* (2013.01)

(58) Field of Classification Search
CPC ..... B63C 11/00; B63C 11/02; B63C 11/12; B63C 11/14; B63C 11/18; B63C 11/186; B63C 11/22; B63C 11/2227; B63C 11/2236; B63C 11/24; B63C 2011/005
See application file for complete search history.

(56) References Cited

U.S. PATENT DOCUMENTS 2,763,262 A * 9/1956 Kimes ..... B63C 11/2227 128/207.16
3,256,910 A * 6/1966 Cupp ..... B63C 11/2227 251/316
5,127,398 A * 7/1992 Stone ..... B64D 10/00 128/205.24
5,690,100 A * 11/1997 Pomerantz ..... A62B 9/02 128/205.24
6,681,766 B1 * 1/2004 Matsuoka ..... B63C 11/2227 128/201.27
6,718,976 B1 * 4/2004 Matsuoka ..... B63C 11/2227 128/205.24
2005/0072427 A1 * 4/2005 Matsuoka ..... B63C 11/2227 128/204.26
2007/0006881 A1 * 1/2007 Hsieh ..... A62B 9/00 128/204.26
2008/0099018 A1 * 5/2008 Clarke ..... A62B 9/022 128/204.26
2009/0320847 A1 * 12/2009 Bozanic ..... A62B 9/022 128/205.24

(Continued)

FOREIGN PATENT DOCUMENTS

GB 2340760 B * 10/2002 ..... B63C 11/2227

*Primary Examiner* — Colin W Stuart

(57) ABSTRACT

A second stage regulator suitable for both right-handed and left-handed divers includes a housing, a mouthpiece, a decompression mechanism, an exhaust mechanism and an airflow adjustment mechanism. The airflow adjustment mechanism can control the output air volume by adjusting the size of the vent. Even in the state of small air volume, the diver only needs to inhale a little to push the second stage output and inhale the air smoothly. The diver can control the direction of the airflow by operating the airflow adjustment mechanism to avoid being choked by the air when the air volume is large. The exhaust holes of the exhaust mechanism is arranged on the side and the exhaust mechanism is facing the left rear side of the housing, which can prevent the exhaust valve from being compressed due to the pressure of water flow when the diver is swimming.

4 Claims, 20 Drawing Sheets

(56) References Cited

U.S. PATENT DOCUMENTS

| | | | | |
|---|---|---|---|---|
| 2010/0186746 | A1* | 7/2010 | Carepa | B63C 11/2227 128/205.24 |
| 2011/0073111 | A1* | 3/2011 | Stone | B63C 11/186 128/205.24 |
| 2013/0186402 | A1* | 7/2013 | Young | B63C 11/24 128/205.12 |
| 2015/0020799 | A1* | 1/2015 | Hipol | B63C 11/186 128/201.11 |
| 2020/0031443 | A1* | 1/2020 | Czernik | B63C 11/2227 |

* cited by examiner

SECOND STAGE REGULATOR

This application claims the benefit of Taiwan Patent Application Serial No. 110213297 filed on Nov. 11, 2021, the subject matter of which is incorporated herein by reference.

BACKGROUND OF INVENTION

1. Field of the Invention

The present invention refers to a second stage regulator for diving, especially refers to a second stage regulator that is suitable for breathing apparatus of scuba diving.

2. Description of the Prior Art

In the scuba diving equipment often used by ordinary scuba divers, the scuba tank can contain compressed air for divers to breathe decompressed air through a breathing apparatus during diving, such breathing apparatus is commonly known as the "second stage" or "second stage regulator" in the technical field of scuba diving.

The conventional second stage usually adjusts the volume of the air-output of the second stage by adjusting the elastic force of its internal spring. This approach has its disadvantages. When the air-output is small, the spring force that the diver needs to resist during inhaling increases, and thus the diver spends more physical exertion even the diver breathes lightly. This is obviously contrary to the purpose that divers generally lower the air-output of the second stage for the sake of saving physical effort and gas. In addition, after the conventional second stage is adjusted to increase the air-output, as soon as the diver inhales, a large amount of air often flows directly into his/her mouth, which is not only uncomfortable but even occasionally choked by the air. Moreover, the conventional second stage also has shortcomings in the design of the air purge button that, the exhaust holes are usually arranged directly in front of the second stage (that is, the direction in front of the diver). When a diver swims forward or encounters a reverse current, the water-flow pressure sometimes presses the purge button of the conventional second stage through the exhaust holes, resulting in unexpected air-output and causing distress. Moreover, the diaphragm design in the exhaust valve of the conventional second stage also often produces a small sound of "po~po~po~ . . . " due to the resonance of the airflow. Furthermore, there is one more serious inconvenience of the conventional second stage; that is, the conventional second stage is usually only suitable for right-handed divers in its connecting configuration of the air hose, exhaust valve and mouthpiece. If the diver is left-handed, he/she needs to buy a second stage with a special structure (the position of the air hose is opposite), otherwise the air hose or exhaust valve will block the mask or get stuck in the neck, etc. During a dive, if a buddy wants to use a diver's spare second stage, that buddy can only swim on the same side of the diver (for example, the left side); otherwise, due to the poor configuration of the conventional second stage structure, the buddy will be hindered by the air hose or exhaust valve of the spare second stage to block the mask or get stuck in the neck, which is very inconvenient.

For these reasons, the present invention discloses a second stage regulator for scuba diving, which can solve the various deficiencies of the aforementioned conventional second stage.

SUMMARY OF THE INVENTION

The primary objective of the invention is to provide a second stage regulator for scuba diving. By properly arranging the relative configuration of the air hose, exhaust valve and mouthpiece, when looking from the mouthpiece of the second stage regulator of this invention toward the housing of the second stage regulator, the exhaust mechanism of the second stage regulator is located on the left side of the housing and is combined with the housing at an inclined angle, which makes the exhaust mechanism facing the left rear of the housing, and the air hose connection end being located on the right side of the housing. Therefore, the second stage regulator of this invention is not only suitable for right-handed and left-handed divers, and moreover, when a buddy wants to borrow a diver's spare second stage, whether the buddy is located on the left or right side of the diver, the second stage regulator of this invention can be easily and comfortably used by the buddy. There is absolutely no disadvantage that the exhaust valve hinders the mask or the air hose gets stuck in the neck.

Another objective of the invention is to provide a second stage regulator for scuba diving. By improving the airflow adjustment mechanism of the second stage regulator, the air volume of the second stage regulator can be controlled by adjusting the size of the vent. Even in the state of a small air volume, the diver only needs to inhale with a small force to make the second stage regulator outputs and inhale the air smoothly, which not only saves air but also saves effort. In addition, the airflow adjustment mechanism of the second stage regulator of this invention also includes an airflow adjust lever. The diver can control the direction of the output air by adjusting the airflow adjust lever to avoid being choked by the air flushing in his/her mouth when the output airflow is large.

A Further objective of the invention is to provide a second stage regulator for scuba diving. The exhaust holes of the purge button of the exhaust mechanism is arranged on the side, and the exhaust mechanism is facing the left rear side of the housing, which can effectively prevent the exhaust valve from being compressed due to the pressure of the water flow when the diver is swimming. In addition, the configuration of air holes of the diaphragm of the exhaust valve is also improved in such a manner that, there is no air hole in a certain area of the diaphragm of the exhaust valve, such unbalanced configuration can avoid resonance sound when exhausting, such that the deficiencies of the aforementioned conventional second stage are overcome.

In order to achieve the aforementioned objectives, the present invention provides a second stage regulator for scuba diving. The second stage regulator comprises: a housing, a mouthpiece, a decompression mechanism, an exhaust mechanism, and an airflow adjustment mechanism. An interior of the housing is provided with a T-shaped interior compartment. The T-shaped interior compartment includes a central channel extending horizontally and laterally and an air outlet channel extending vertically from a middle section of the central channel. Two ends of the central channel are a first insert opening and a second insert opening respectively. An air outlet is formed at an end of the air outlet channel. The mouthpiece is assembled on the air outlet of the housing. The decompression mechanism is arranged in the central channel of the T-shaped interior compartment of the housing. One end of the decompression mechanism is located at the first insert opening and is connectable with an air hose. Another end of the decompression mechanism is located near the second insert opening. The decompression mechanism is able to control the supply of air from the air hose and guide the air to the air outlet. The exhaust mechanism is exposed in the second insert opening of the housing and connected with said another end of the decompression mechanism. The airflow adjustment mechanism is located in the central channel of the T-shaped interior compartment of the housing and sleeved outside the decompression mechanism. By operating the airflow adjustment mechanism, volume and direction of the air flowing toward the air outlet through the decompression mechanism can be adjusted. Wherein, when looking from the mouthpiece toward the housing of the second stage regulator, the exhaust mechanism is located on the left side of the housing and is combined with the housing at an inclined angle facing toward the left rear of the housing; such that, the second insert opening of the housing is facing toward the left rear side of the housing, while a connection end where the decompression mechanism is connectable with the air hose is located on the right side of the housing.

In a preferred embodiment, a deflector extending horizontally and laterally is arranged in the air outlet of the housing to disturb an airflow from the decompression mechanism and prevent a large amount of the air from directly rushing to the mouthpiece.

In a preferred embodiment, the decompression mechanism comprises: an airflow shaft, a piston, a spring, a balance chamber, a lever seat, a lever arm, an orifice cap, and a plurality of O-rings. The airflow shaft is an elongated hollow sleeve structure, and its right and left ends are respectively a first cylinder opening and a second cylinder opening. A threaded joint is provided on an outer surface of the first cylinder opening at the right end of the airflow shaft, and at least one guide groove is provided on an outer surface of the second cylinder opening at the left end of the airflow shaft. A vent is formed in a middle section of the airflow shaft. The piston is inserted in the airflow shaft from the second cylinder opening. The piston has a head end with a relatively larger outer diameter on the side adjacent to the first cylinder opening, and a thread end with a relatively smaller outer diameter on the side adjacent to the second cylinder mouth. A center of the piston has an air passage extending horizontally and laterally. A small air-hole is provided on the piston at a position corresponding to the vent, wherein the small air-hole is communicated with the air passage. The spring is sleeved outside the piston and sandwiched between the piston and the airflow shaft. The balance chamber is sleeved outside the piston and sandwiched between the piston and the airflow shaft. The spring is sandwiched between the balance chamber and the head end of the piston. By pulling the thread end of the piston, the head end can be displaced horizontally and laterally toward the balance chamber, thereby compressing the spring. When the pulling of the thread end stops, the piston will return to its original position due to an elastic force of the spring. The lever seat is sleeved outside the piston and is assembled with the balance chamber. One end of the lever arm is combined and locked with the thread end of the piston through a thread nut. By pressing the other end of the lever arm, the thread end of the piston can be pulled so that the head end is displaced horizontally and laterally toward the balance cylinder. The orifice cap is inserted in the airflow shaft through the first cylinder opening for abutting and positioning the head end of the piston. The O-rings are respectively disposed at predetermined positions of the airflow shaft, the piston and the orifice cap, in order to provide functions of air tightness and forming an airflow passage between the airflow shaft and the piston.

In a preferred embodiment, the exhaust mechanism comprises: a diaphragm, an exhaust valve, an exhaust valve cap, a purge button, and a cover retainer. The diaphragm is made of soft material and located at the second insert opening of the housing. An air chamber is formed between the diaphragm and the second insert opening of the T-shaped interior compartment of the housing. A plurality of air holes is arranged on a surface of the diaphragm. The exhaust valve covers the air holes on the surface of the diaphragm. The exhaust valve is made of soft material and has a positioning plug which penetrates through a button hole in the center of the diaphragm and then protrudes out of the other side of the diaphragm away from the exhaust valve. The exhaust valve cap is located on the other side of the diaphragm relative to the exhaust valve. The exhaust valve cap buckles the inner edges of the air holes of the exhaust valve, and covers the positioning plug; the other end of the lever arm is adjacent to the exhaust valve cap. The purge button is made of soft material and located at the second insert opening of the housing. The purge button is stacked on the diaphragm and the exhaust valve, so that the exhaust valve is located between the purge button and the diaphragm. A plurality of exhaust holes is provided on a peripheral side of the purge button. The exhaust valve cap and the diaphragm can be compressed by pressing the purge button, causing the exhaust valve cap to press the other end of the lever arm. Thereby, the thread end of the piston is pulled so that the head end is displaced horizontally and laterally toward the balance chamber and compresses the spring. The cover retainer is assembled on the second insert opening of the housing in such a manner that, the diaphragm, the exhaust valve, and the purge button are clamped and positioned on the second insert opening of the housing by means of the cover retainer.

In a preferred embodiment, the airflow adjustment mechanism comprises: a hollow airflow adjust tube, a hollow airflow adjust lever, an airflow knob, an end cap, and a shaft nut. The hollow airflow adjust tube is sleeved outside the airflow shaft and adjacent to the vent of the airflow shaft. The airflow adjust tube can be driven to perform horizontal lateral displacement relative to the airflow shaft, so as to partially cover the vent of the airflow shaft, or expose the vent to the outside of the airflow adjust tube. The hollow airflow adjust lever is sleeved outside the airflow adjust tube and corresponding to the vent of the airflow shaft. The airflow adjust lever has a fender and a lever bulge. By turning the lever bulge, the airflow adjust lever can be rotated to allow the fender to block the vent of the airflow shaft, or to expose the vent outside the fender. The airflow knob is assembled on one end of the airflow adjust tube. By rotating the airflow knob, the airflow adjust tube can be driven to perform a horizontal lateral displacement relative to the airflow shaft. The end cap is assembled on the airflow knob. The end cap limits the airflow knob to perform only rotational movement but not horizontal and lateral movement. The shaft nut is locked on the threaded joint at the right end of the airflow shaft. Wherein, an opening is provided in the first insert opening of the housing. The lever bulge of the airflow adjust lever is exposed in the opening of the housing. Wherein, by rotating the airflow knob to make the airflow adjust tube partially cover the vent of the airflow shaft, the function of adjusting the amount of airflow can be achieved. By turning the lever bulge of the airflow adjust lever to make the fender of the airflow adjust lever block the vent of the airflow shaft, the function of changing the direction of airflow can be achieved.

In a preferred embodiment, wherein the plurality of air holes on the diaphragm are arranged in a ring-shaped arrangement, but one of the locations in the ring-shaped arrangement is not provided with the air hole.

BRIEF DESCRIPTION OF THE DRAWINGS

The present invention will now be specified with reference to its preferred embodiment illustrated in the drawings, in which.

DESCRIPTION OF THE PREFERRED EMBODIMENT

The present invention provides a second stage regulator for diving, which comprises a housing, a mouthpiece, a decompression mechanism, an exhaust mechanism and an airflow adjustment mechanism. When looking from the mouthpiece toward the housing of the second stage regulator, the exhaust mechanism is located on the left side of the housing and is combined with the housing at an inclined angle, and the air hose connection end is located on the right side of the housing. Therefore, the second stage regulator is not only suitable for right-handed and left-handed divers, but also that the exhaust valve will not hinder the mask nor the air hose get stuck in the neck. In addition, the air volume of the second stage regulator can be controlled by adjusting the size of the vent. Even in the state of a small air volume, the diver only needs to inhale with a small force to make the second stage regulator outputs and inhale the air smoothly, which not only saves air but also saves effort. Moreover, the airflow adjustment mechanism of the second stage regulator also includes an airflow adjust lever. The diver can control the direction of the output air by adjusting the airflow adjust lever to avoid being choked by the air flushing in his/her mouth when the output airflow is large. The exhaust holes of the purge button of the exhaust mechanism is arranged on the side, and the exhaust mechanism is facing the left rear side of the housing, which can effectively prevent the exhaust valve from being compressed due to the pressure of the water flow when the diver is swimming. Furthermore, the configuration of air holes of the diaphragm of the exhaust valve is also improved in such a manner that, there is no air hole in a certain area of the diaphragm of the exhaust valve, such unbalanced configuration can avoid resonance sound when exhausting. As a result, the deficiencies of the aforementioned conventional second stage are overcome by the second stage regulator of the present invention.

In order to more clearly describe the second stage regulator proposed by this creation, the following will be described in detail with the drawings.

Figure 1:
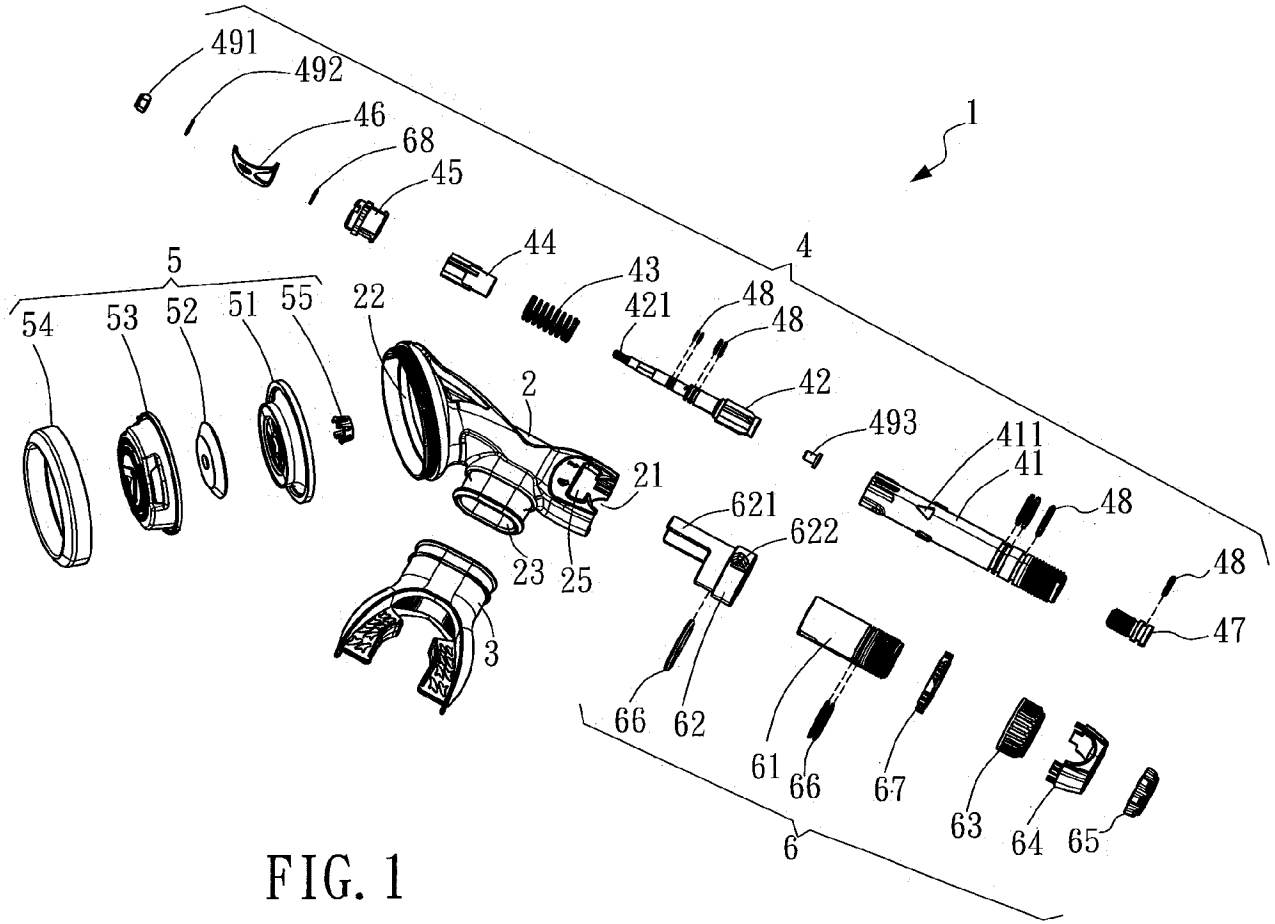
FIG. 1 is an exploded perspective view of an embodiment of the second stage regulator in the present invention.
Figure 2:
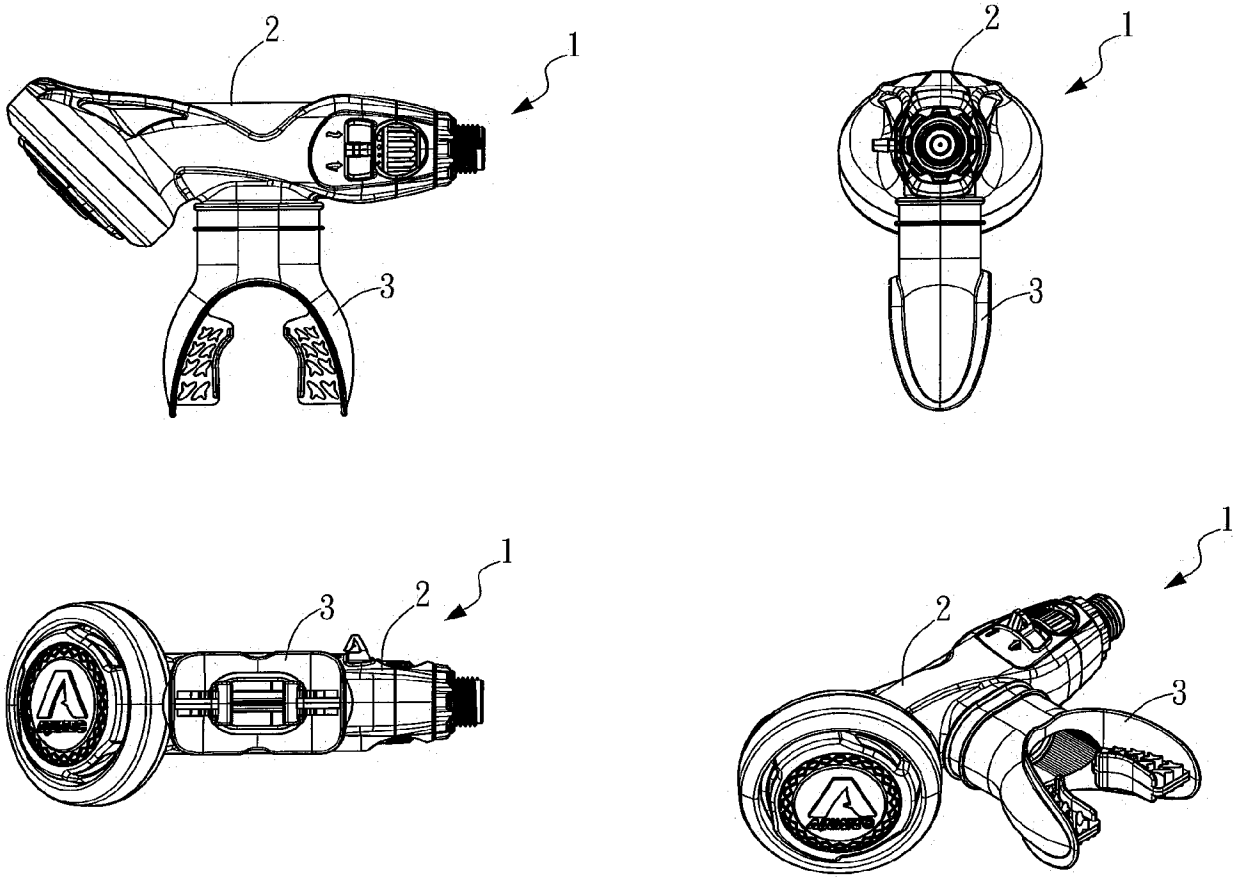
FIG. 2 shows three side views and a perspective view of an embodiment of the assembled second stage regulator of the present invention.
Figure 3:
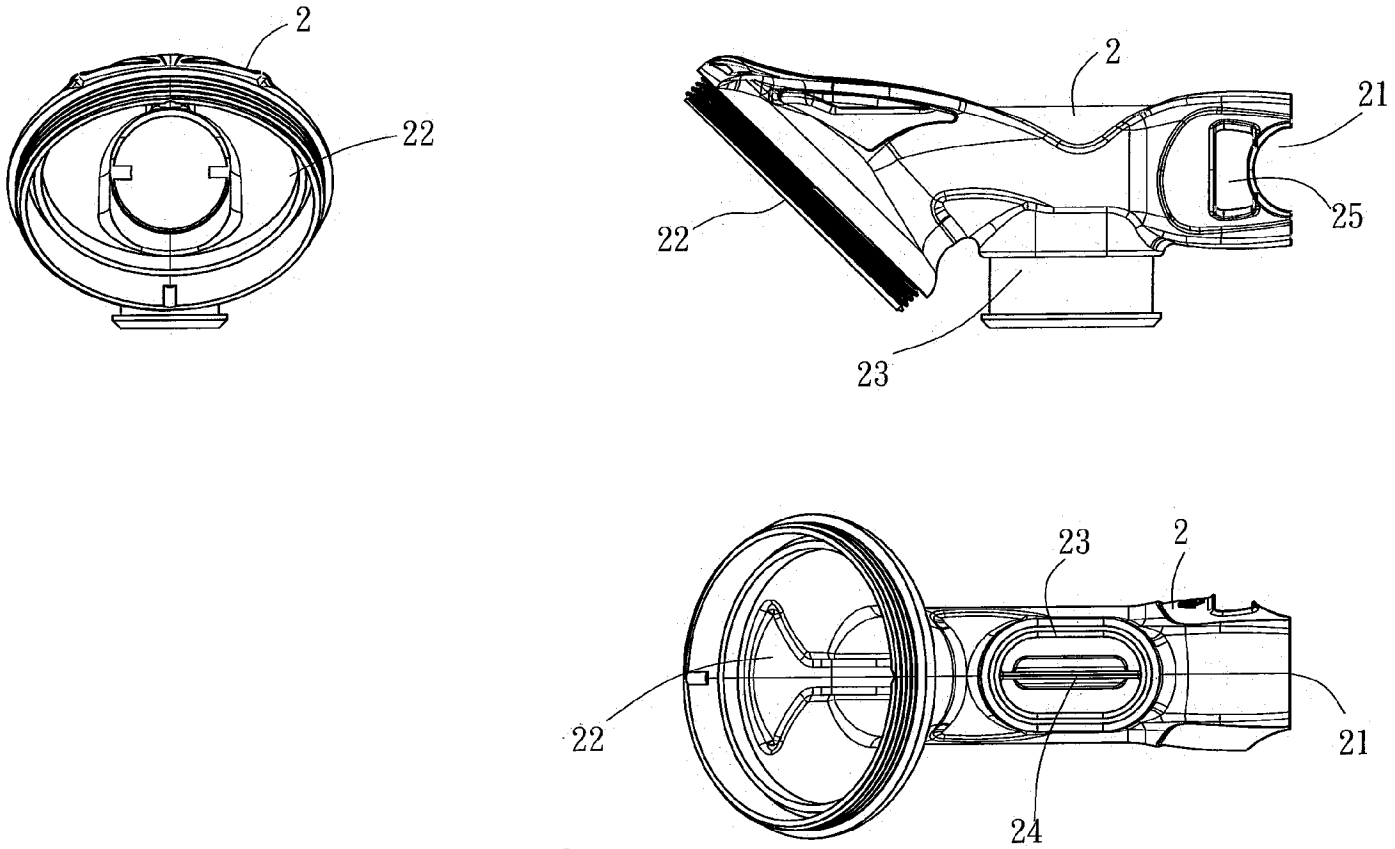
FIG. 3 shows three side views of the housing of the second stage regulator of this invention.
Figure 4:
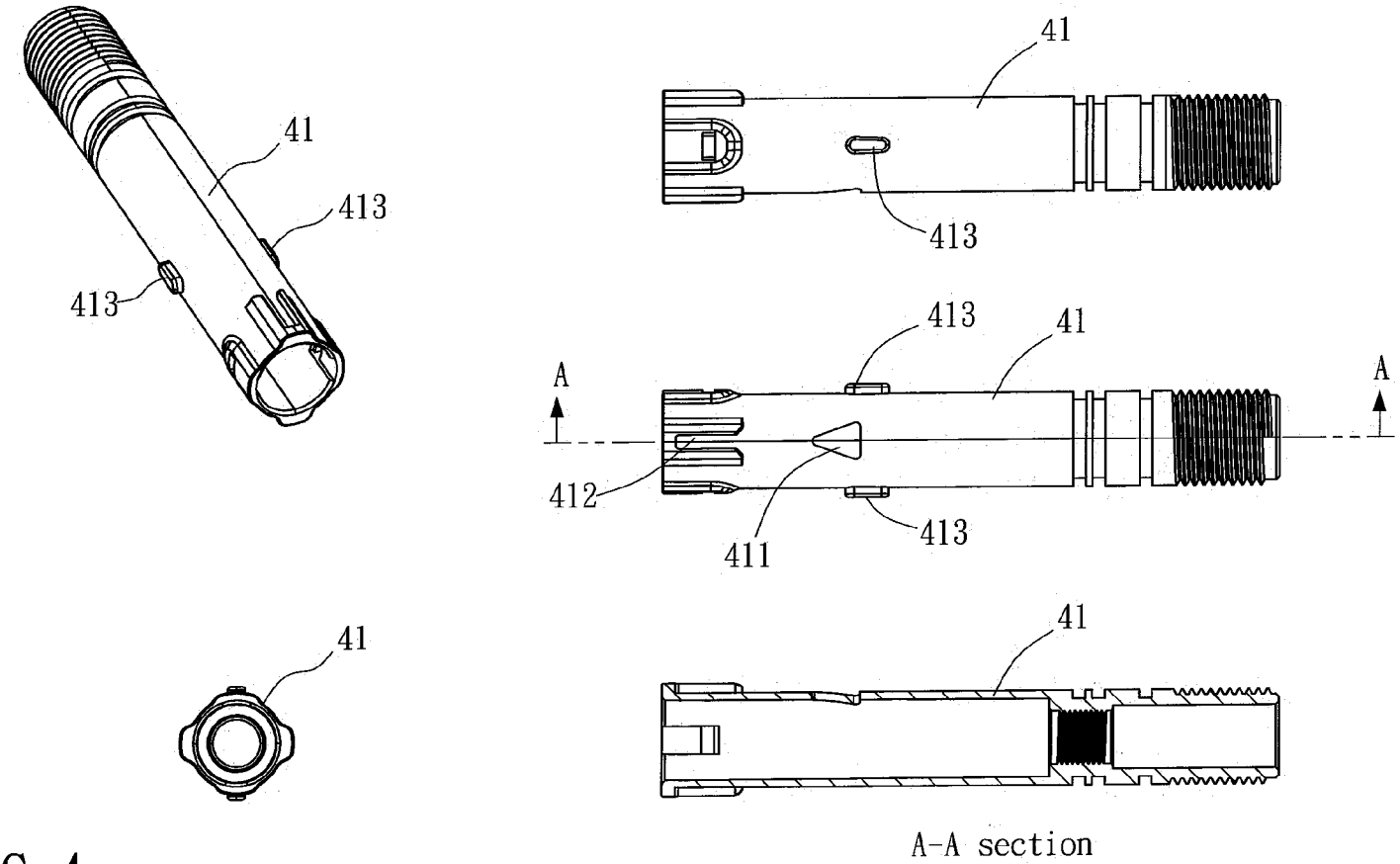
FIG. 4 shows three side views, a sectional view and a perspective view of the airflow shaft of the second stage regulator of the present invention.
Figure 5:
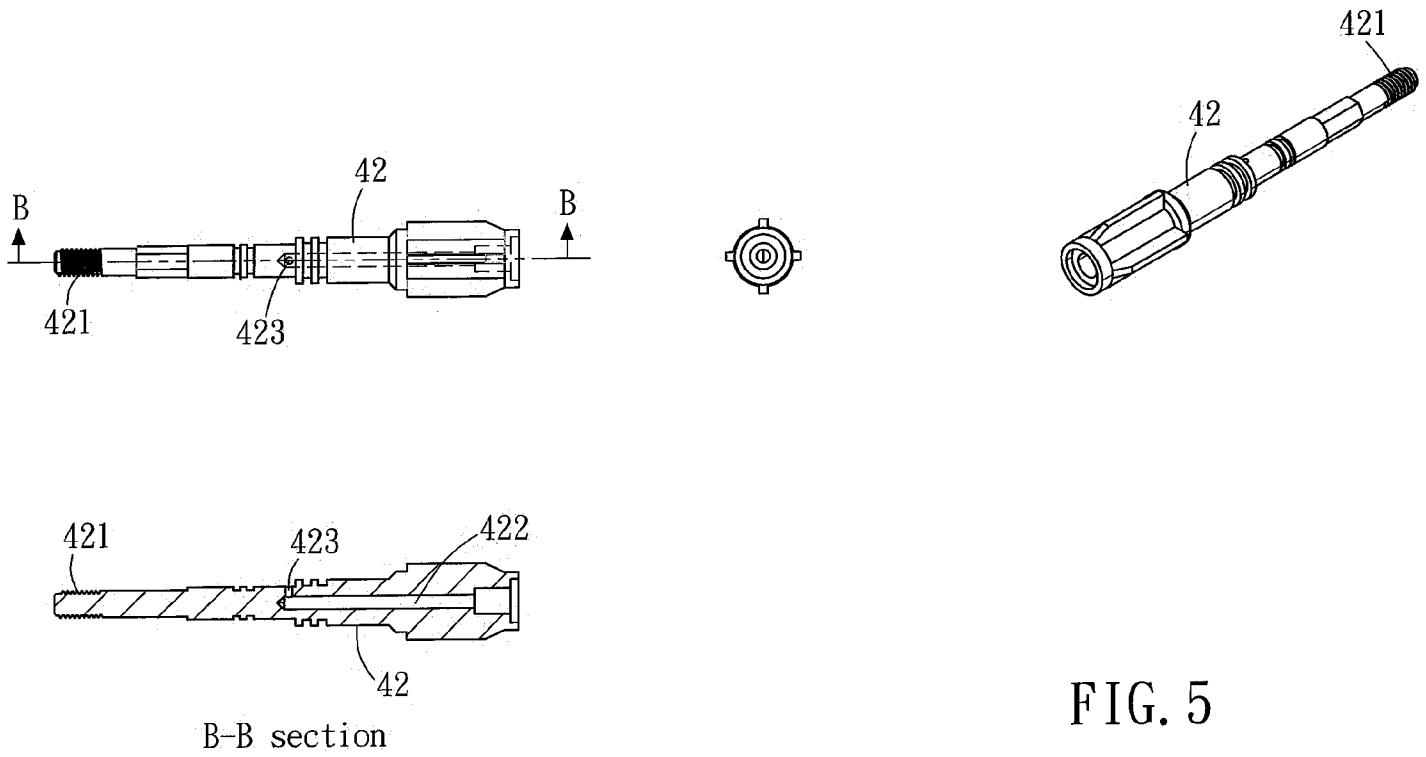
FIG. 5 is a front view, a sectional view and a perspective view of the piston of the second stage regulator of the present invention.
Figure 6:
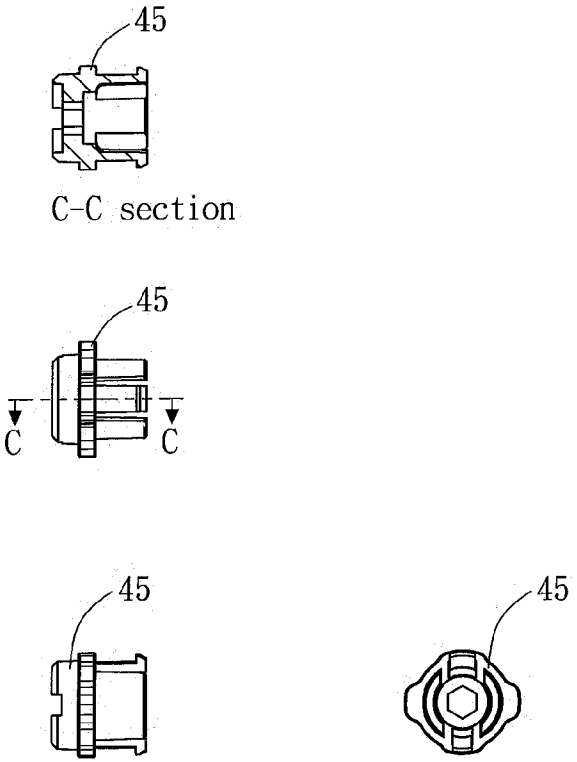
FIG. 6 shows three side views and a cross-sectional view of the lever seat of the second stage regulator of the present invention.
Figure 7:
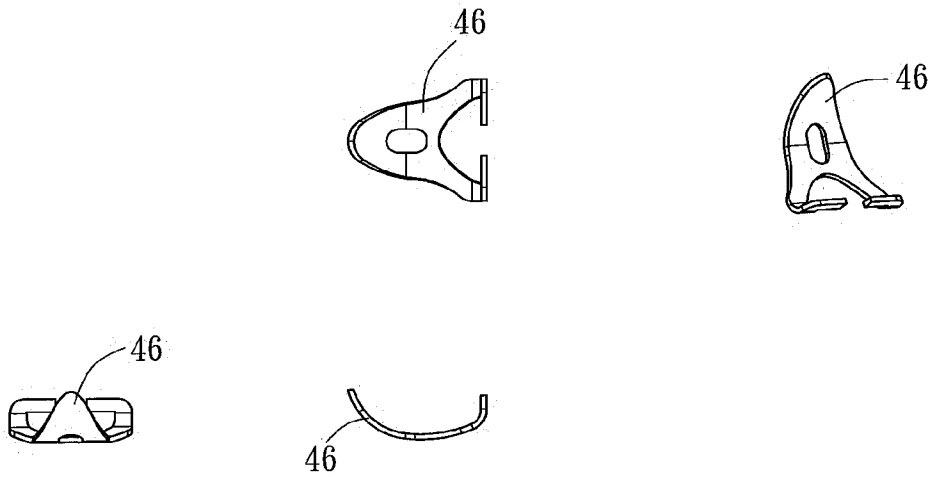
FIG. 7 shows three side views and a perspective view of the lever arm of the second stage regulator of the present invention.
Figure 8:
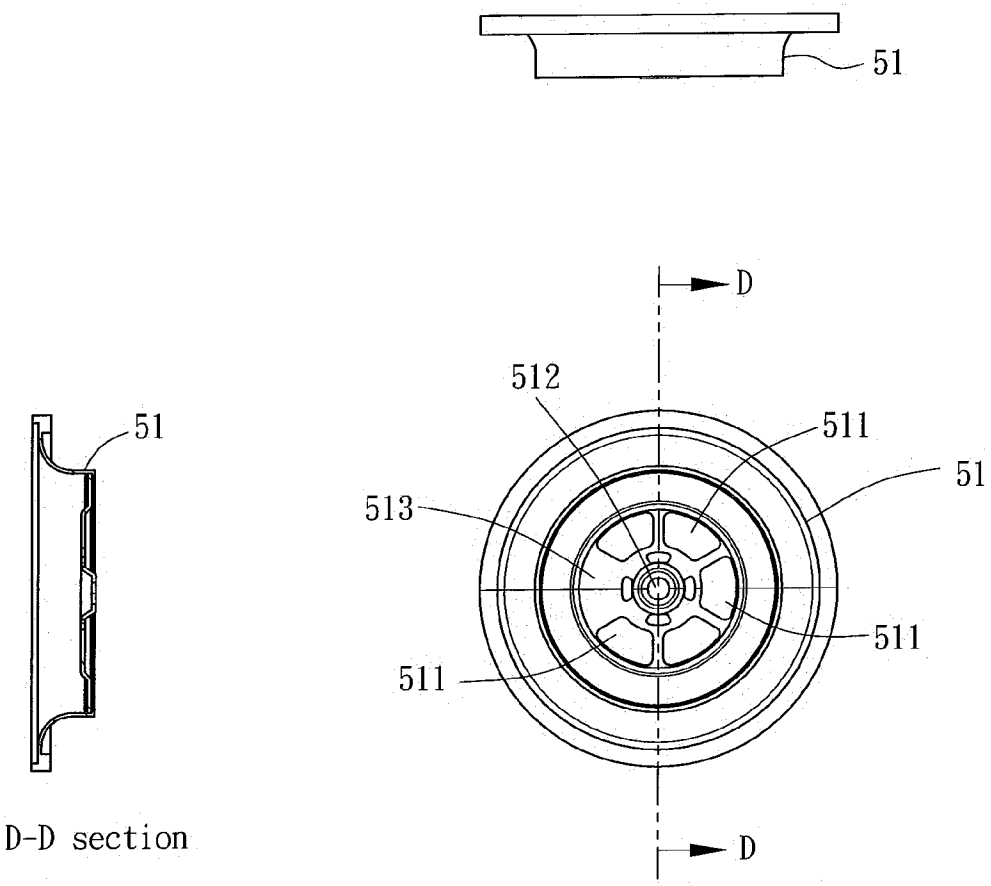
FIG. 8 shows two side views and a cross-sectional view of the diaphragm of the second stage regulator of the present invention.
Figure 9:
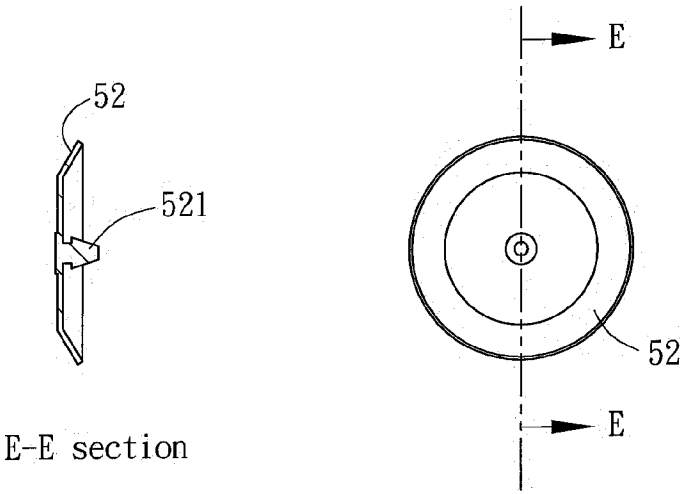
FIG. 9 shows a front view and a cross-sectional view of the exhaust valve of the second stage regulator of the present invention.
Figure 10:
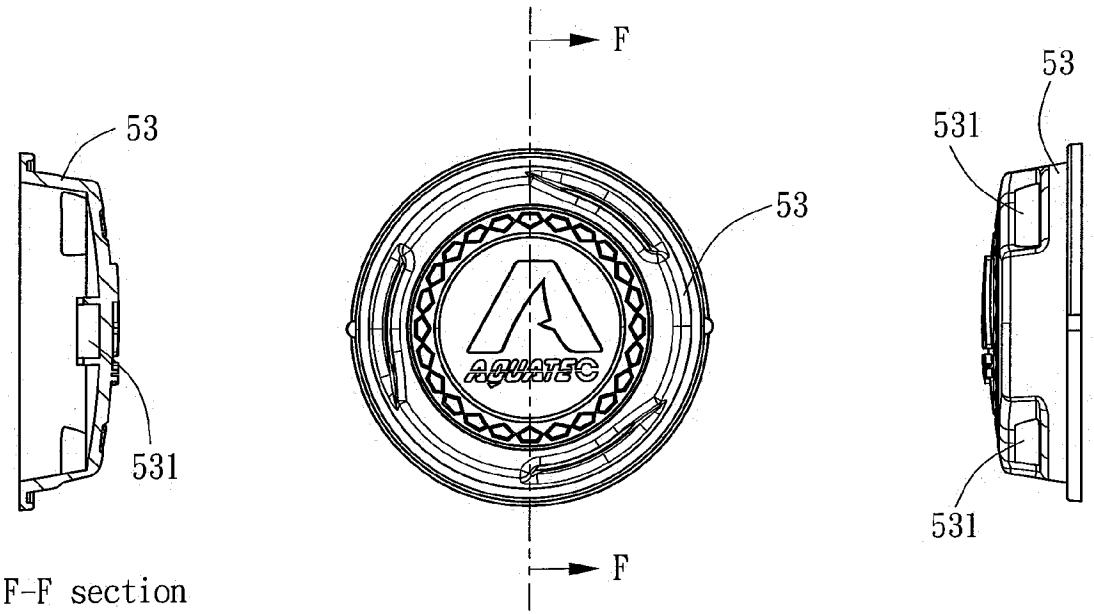
FIG. 10 shows two side views and a cross-sectional view of the purge button of the second stage regulator of the present invention.
Figure 11:
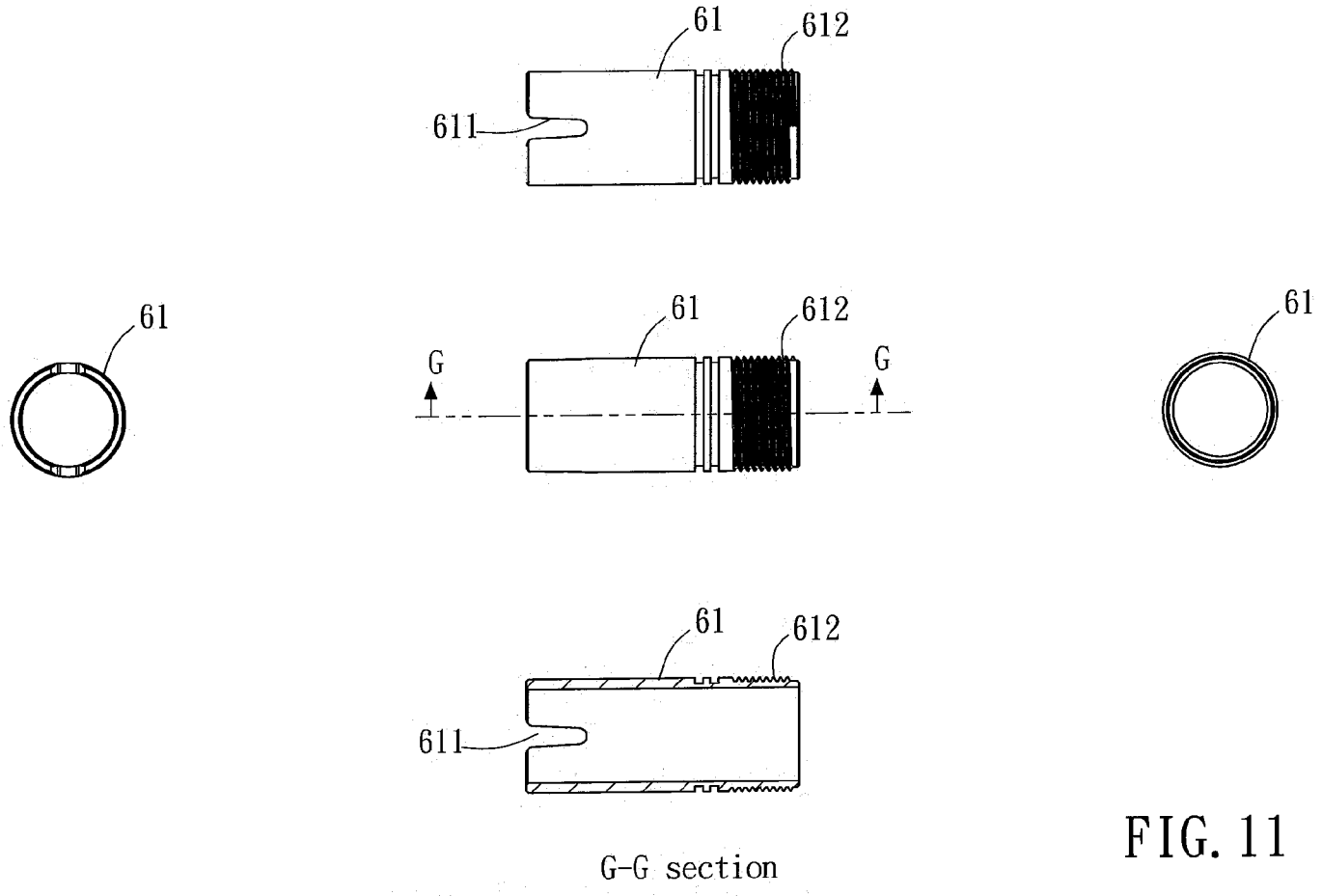
FIG. 11 shows four side views and a cross-sectional view of the airflow adjust tube of the second stage regulator of the present invention.
Figure 12:
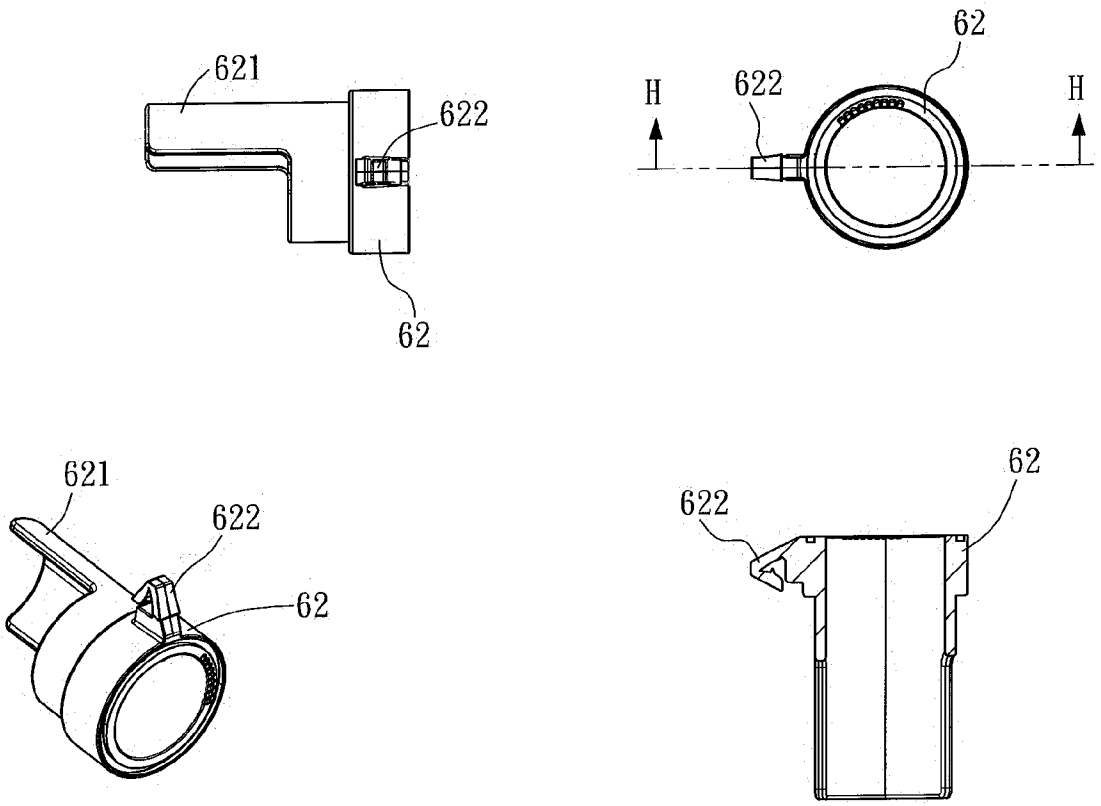
FIG. 12 shows two side views and a cross-sectional view and a perspective view of the airflow adjust lever of the second stage regulator of the present invention.
Figure 13:
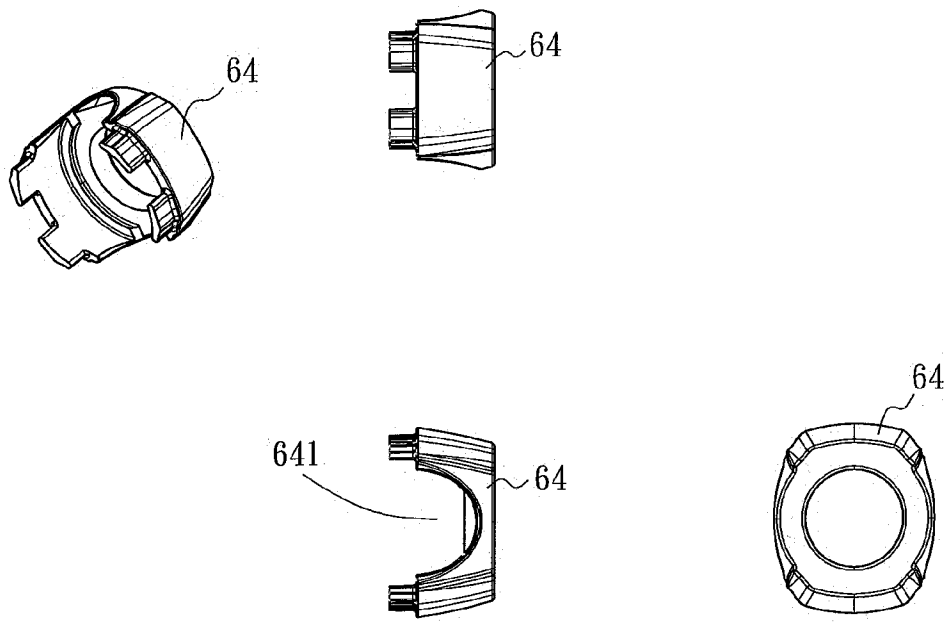
FIG. 13 shows three side views and a perspective view of the end cap of the second stage regulator of the present invention.
Figure 14:
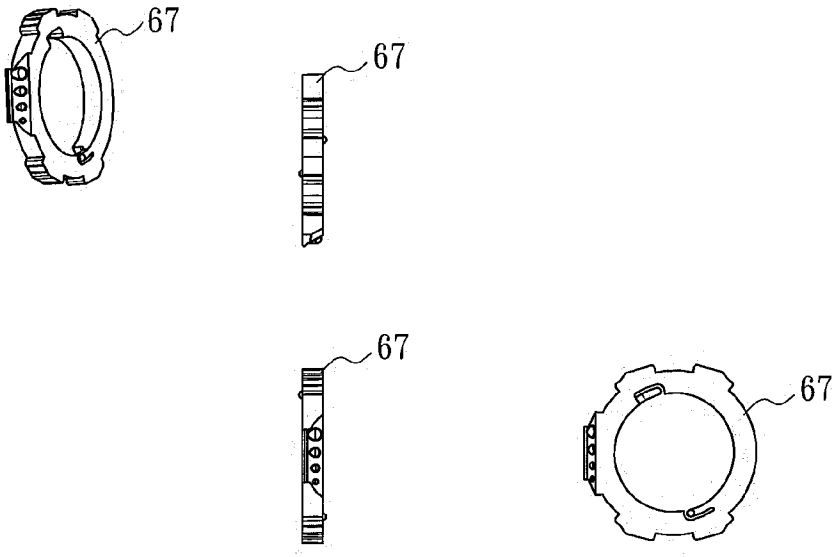
FIG. 14 shows three side views and a perspective view of the baffle of the second stage regulator of the present invention.

Please refer to FIG. 1 to FIG. 14; in which, FIG. 1 is an exploded perspective view of an embodiment of the second stage regulator in the present invention; FIG. 2 shows three side views and a perspective view of an embodiment of the assembled second stage regulator of the present invention; FIG. 3 shows three side views of the housing of the second stage regulator of this invention; FIG. 4 shows three side views, a sectional view and a perspective view of the airflow shaft of the second stage regulator of the present invention; FIG. 5 is a front view, a sectional view and a perspective view of the piston of the second stage regulator of the present invention; FIG. 6 shows three side views and a cross-sectional view of the lever seat of the second stage regulator of the present invention; FIG. 7 shows three side views and a perspective view of the lever arm of the second stage regulator of the present invention; FIG. 8 shows two side views and a cross-sectional view of the diaphragm of the second stage regulator of the present invention; FIG. 9 shows a front view and a cross-sectional view of the exhaust valve of the second stage regulator of the present invention; FIG. 10 shows two side views and a cross-sectional view of the purge button of the second stage regulator of the present invention; FIG. 11 shows four side views and a cross-sectional view of the airflow adjust tube of the second stage regulator of the present invention; FIG. 12 shows two side views and a cross-sectional view and a perspective view of the airflow adjust lever of the second stage regulator of the present invention; FIG. 13 shows three side views and a perspective view of the end cap of the second stage regulator of the present invention; FIG. 14 shows three side views and a perspective view of the baffle of the second stage regulator of the present invention.

In this embodiment, the second stage regulator 1 comprises: a housing 2, a mouthpiece 3, a decompression mechanism 4, an exhaust mechanism 5 and an airflow adjustment mechanism 6.

The interior of the housing 2 is provided with a T-shaped interior compartment. The T-shaped interior compartment includes a central channel extending horizontally and laterally and an air outlet channel extending vertically from a middle section of the central channel. Two ends of the central channel are a first insert opening 21 and a second insert opening 22 respectively, and an air outlet 23 is formed at the end of the air outlet channel. The mouthpiece 3 is assembled and exposed on the air outlet 23 of the housing 2. The decompression mechanism 4 is arranged in the central channel of the T-shaped interior compartment of the housing 2. One end of the decompression mechanism 4 is located at the first insert opening 21 and can be connected to a first stage regulator via an air hose (not shown in the figures), wherein the first stage is assembled to a scuba tank containing compressed air. The other end of the decompression mechanism 4 is located near the second insert opening 22. The decompression mechanism 4 can control the supply of the air from the air hose and the first stage and guide the air to the air outlet. The exhaust mechanism 5 is exposed in the second insert opening 22 of the housing 2 and is connected (contacted) with the free end of the lever arm 46 at the other end of the decompression mechanism 4. The airflow adjustment mechanism 6 is located in the central channel of the T-shaped interior compartment of the housing 2 and is sleeved outside the decompression mechanism 4. By operating the airflow adjustment mechanism 6, the volume and direction of the air flowing toward the air outlet 23 through the decompression mechanism 4 can be adjusted. When looking from the mouthpiece 3 toward the housing 2 of the second stage regulator 1, the exhaust mechanism 5 is located on the left side of the housing 2 and is combined with the housing 2 at an inclined angle facing toward the left rear of the housing 2. That is, the second insert opening 22 of the housing 2 is facing toward the left rear side of the housing 2, while the air hose connection end (i.e., the threaded joint on the right end of the airflow shaft 41) is located on the right side of the housing 2. Therefore, the second stage regulator 1 of this invention not only is suitable for both right-handed and left-handed divers, and moreover, when a buddy wants to borrow a diver's spare second stage, whether the buddy is located on the left or right side of the diver, the second stage regulator 1 of this invention can be easily and comfortably used by the buddy. There is absolutely no disadvantage that the exhaust valve hinders the mask or the air hose gets stuck in the neck. In addition, a deflector 24 extending horizontally and laterally is arranged in the air outlet 23 of the housing 2 to disturb the airflow from the decompression mechanism 4 and prevent a large amount of air from directly rushing to the mouthpiece 3.

In this embodiment, the decompression mechanism 4 comprises: an airflow shaft 41, a piston 42, a spring 43, a balance chamber 44, a lever seat 45, a lever arm 46, an orifice cap 47, a plurality of O-rings 48, a left thread nut 491, a washer 492, and a balance seat 493. The airflow shaft 41 is an elongated hollow sleeve structure, and its right and left ends are respectively a first cylinder opening and a second cylinder opening. A threaded joint is provided on the outer surface of the first cylinder opening at the right end of the airflow shaft 41, and at least one guide groove 412 is provided on the outer surface of the second cylinder opening at the left end of the airflow shaft 41. A vent 411 is formed in a middle section of the airflow shaft 41, and a plurality of protruding ribs 413 is formed on the outer surface of the airflow shaft 41. The rod-like piston 42 is inserted into the airflow shaft 41 from the second cylinder opening. The piston 42 has a head end with a relatively larger outer diameter on the side adjacent to the first cylinder opening, and a thread end 421 with a relatively smaller outer diameter on the side adjacent to the second cylinder mouth. The center of the piston 42 has an air passage 422 extending horizontally and laterally. A small air-hole 423 is provided on the piston 42 at a position corresponding to the vent 411 in the horizontal direction, wherein the small air-hole 423 is communicated with the air passage 422. The spring 43 is sleeved outside the piston 42 and sandwiched between the piston 42 and the airflow shaft 41. The right end of the spring 43 is sleeved on the periphery of the piston 42 and abuts against the head end (with a relatively larger outer diameter) of the piston 42. The balance chamber 44 is sleeved outside the piston 42 and sandwiched between the piston 42 and the airflow shaft 41. In addition, the left end of the spring 43 abuts against the balance chamber 44, so the spring 43 is sandwiched between the balance chamber 44 and the head end of the piston 42. By pulling the thread end 421 of the piston 42 toward the left, the head end can be displaced horizontally and laterally toward the balance chamber 44, thereby compressing the spring 43. When the pulling force applied to the thread end 421 disappears, the piston 42 can return to its original position due to the elastic force of the spring 43. The lever seat 45 is sleeved outside the piston 42 and is assembled with the balance chamber 44. One end (i.e., the fulcrum end) of the lever arm 46 is combined and locked with the thread end 421 of the piston 42 through the washer 492 and the thread nut 491. By pressing the other end of the lever arm 46, the thread end 421 of the piston 42 can be pulled so that the head end is displaced horizontally and laterally toward the balance cylinder 44, thereby compressing the spring 43 to generate elastic force. The balance seat 493 is plugged into the head end of the piston 42 to assist in adjusting and balancing the air pressure. The hollow orifice cap 47 is inserted into the airflow shaft 41 through the first cylinder opening, and is used for abutting and positioning the head end of the piston 42. Several O-rings 48 are respectively disposed at appropriate positions of the airflow shaft 41, the piston 42 and the orifice cap 47, in order to provide the functions of air tightness, and forming an airflow passage between the airflow shaft 41 and the piston 42, and forming an air pressure balance chamber between the two pairs of O-rings 48 of the piston 42.

In this embodiment, the exhaust mechanism 5 comprises: a diaphragm 51, an exhaust valve 52, a purge button 53, a cover retainer 54, and an exhaust valve cap 55. The diaphragm 51 is made of soft material (such as silicone) and is located at the second insert opening 22 of the housing 2. An air chamber is formed between the diaphragm 51 and the second insert opening 22 of the T-shaped interior compartment of the housing 2. A plurality of air holes 511 is arranged on a surface of the diaphragm 51. The exhaust valve 52 covers the air holes 511 on the surface of the diaphragm 51. Wherein, the plurality of air holes 511 on the diaphragm 51 are arranged in a ring-shaped arrangement, but one of the locations 513 in the ring-shaped arrangement is not provided with the air hole. Typically speaking, as shown in FIG. 8, a middle area of the surface of the diaphragm 51 is roughly divided into six sections, in which, only five of the sections are provided with the air holes 511, while the other one section at the location 513 is not provided with any air hole. Such unbalanced configuration of the air holes 511 can avoid resonance sound when exhausting air through the diaphragm 51. The exhaust valve 52 is made of soft material (such as silicone) and has a positioning plug 521 which penetrates through a button hole 512 in the center of the diaphragm 51 and then protrudes out of the other side of the diaphragm 51 away from the exhaust valve 52. The exhaust valve cap 55 is located on the other side of the diaphragm 51 relative to the exhaust valve 52, buckles the inner edges of the air holes 511 of the exhaust valve 52 (but do not block the air holes 511), and covers the positioning plug 521. The other end (the free end or the effort end) of the lever arm 46 is adjacent to the bottom surface of the exhaust valve cap 55. The purge button 53 is made of soft material (such as silicone) and is located at the second insert opening 22 of the housing 2, and is stacked on the diaphragm 51 and the exhaust valve 52, so that the exhaust valve 52 is located between the purge button 53 and the diaphragm 51. In addition, a plurality of exhaust holes 531 is provided on the peripheral side of the purge button 53. Since the exhaust holes 531 are arranged on the peripheral side of the purge button 53, and the structure of the exhaust mechanism 5 is facing toward the left rear of the housing 2, therefore it can effectively prevent the exhaust valve from being pressurized for outputting air due to the water flow pressure when the diver is swimming. In addition, the exhaust valve cap 55 and the diaphragm 51 can be compressed by pressing the purge button 53, causing the exhaust valve cap 55 to press the other end of the lever arm 46. Thereby, the thread end 421 of the piston 42 is pulled so that the head end is displaced horizontally and laterally toward the balance chamber 44 and compresses the spring 43. The cover retainer 54 is assembled on the second insert opening 22 of the housing 2 in such a manner that, the diaphragm 51, the exhaust valve 52, and the purge button 53 are clamped and positioned on the second insert opening 22 of the housing 2 by means of the cover retainer 54.

In this embodiment, the airflow adjustment mechanism 6 comprises: a hollow airflow adjust tube 61, a hollow airflow adjust lever 62, an airflow knob 63, an end cap 64, a shaft nut 65, a plurality of O-rings 66, and a baffle 67. The hollow airflow adjust tube 61 is sleeved outside the airflow shaft 41 and is adjacent to the vent 411 of the airflow shaft 41. The airflow adjust tube 61 can be driven to perform horizontal lateral displacement relative to the airflow shaft 41, so as to partially cover the vent 411 of the airflow shaft 41, or expose the vent 411 to the outside of the airflow adjust tube 61, so as to provide the function of adjusting the size of the ventilated area (air output volume) of the vent 411. Several guide grooves 611 are provided at the left end of the airflow adjust tube 61, the size and position of which are corresponding to the protruding ribs 413 of the airflow shaft 41. By receiving the protruding ribs 413 into the corresponding guide grooves 611, the airflow adjust tube 61 can only perform horizontal lateral displacement relative to the airflow shaft 41 and cannot rotate. The hollow airflow adjust lever 62 is sleeved outside the airflow adjust tube 61 and corresponds to the vent 411 of the airflow shaft 41. In addition, the airflow adjust lever 62 can rotate relative to the airflow shaft 41. The airflow adjust lever 62 has a fender 621 and a lever bulge 622. By turning the lever bulge 622, the airflow adjust lever 62 can be rotated to allow the fender 621 to block the vent 411 of the airflow shaft 41, or to expose the vent 411 outside the fender 621. Moreover, even when the fender 621 completely blocks the vent 411 of the airflow shaft 41, a gap is still kept between the fender 621 and the vent 411, so that the airflow can still flow out from the vent 411, but the airflow will be disturbed by the fender 621 and the airflow direction will also be changed. The airflow knob 63 is assembled on one end (right end) of the airflow adjust tube 61 by screw threads. By rotating the airflow knob 63, the airflow adjust tube 61 can be driven to convert the rotational motion of the threads into a horizontal lateral displacement relative to the airflow shaft 41. The end cap 64 is assembled on the airflow knob 63 and is further assembled at the first insert opening 21 end of the housing 2, which can limit the airflow knob 63 to perform only rotational movement but not horizontal and lateral movement. The end cap 64 has several cutout portions 641 that expose some parts of the outer surface of the airflow knob 63 to the outside for the divers to rotate and operate with their fingers. The shaft nut 65 is locked on the threaded joint at the right end of the airflow shaft 41, and is used to combine and fix the airflow adjustment mechanism 6 and the decompression mechanism 4 with the housing 2. Several O-rings 66 are respectively disposed at appropriate predetermined positions of the airflow adjust tube 61, the airflow adjust lever 62 and the airflow knob 63 to provide air-tightness function. The baffle 67 is sleeved on the airflow adjust tube 61 and is sandwiched between the airflow adjust lever 62 and the airflow knob 63, which is used to mark the switching positions of the lever bulge 622 and/or the airflow knob 63 and improve the feel of switching the lever bulge 622. Typically speaking, the baffle 67 is sandwiched between and contact with both the airflow adjust lever 62 and the airflow knob 63, and the baffle 67 is formed with some positioning structures such as positioning bumps or positioning concaves. Therefore, when operating the airflow adjust lever 62 or the airflow knob 63, there will be a slight rattling sound and tactile sensation between its contact surface with the baffle 67, so as to improve the feel of switching. Wherein, an opening 25 is provided in the first insert opening 21 of the housing 2. The lever bulge 622 of the airflow adjust lever 62 is exposed in the opening 25 of the housing 2 for the diver to operate with his/her fingers. By rotating the airflow knob 63 to make the airflow adjust tube 61 partially cover (or completely open) the vent 411 of the airflow shaft 41, the function of adjusting the amount of airflow can be achieved. By turning the lever bulge 622 of the airflow adjust lever 62 to make the fender 621 of the airflow adjust lever 62 block (or open) the vent 411 of the airflow shaft 41, the function of changing the direction of airflow can be achieved.

Figure 15A:
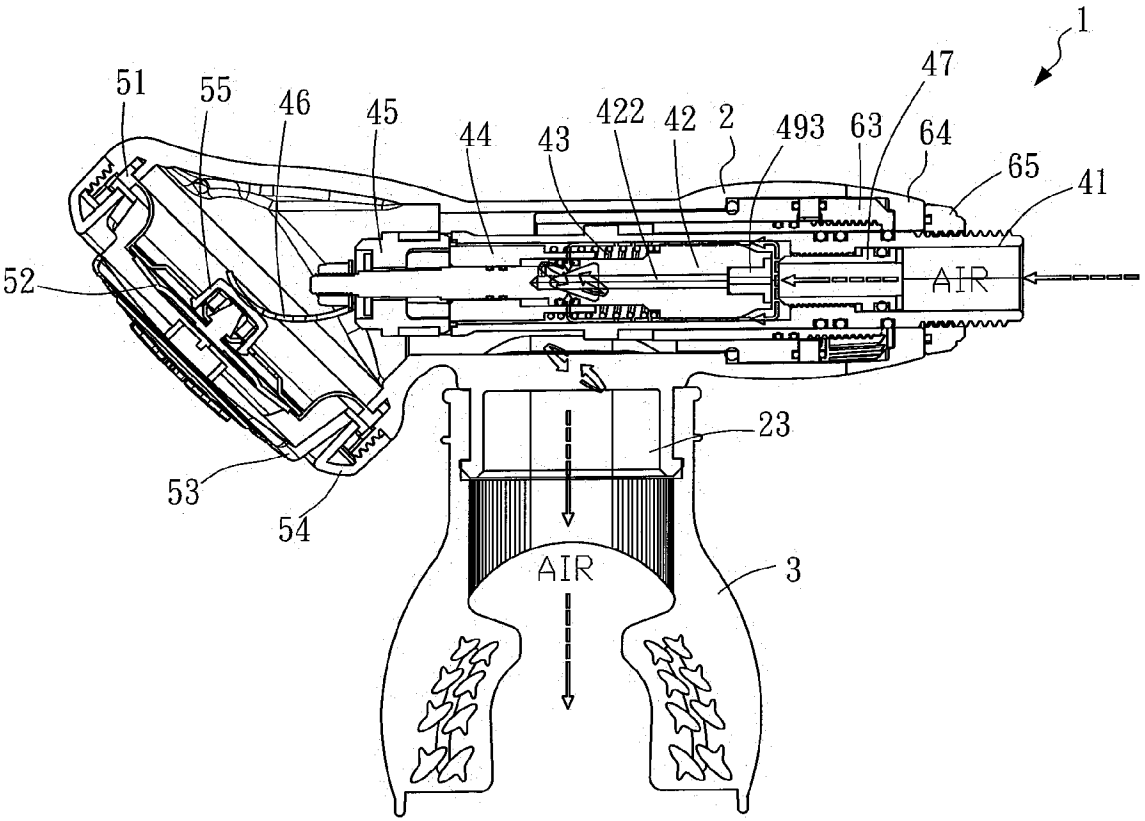
FIG. 15A and FIG. 15B are schematic diagrams of the airflow directions when the second stage regulator of the invention is respectively inhaled and exhaled through the mouthpiece.
Figure 15B:
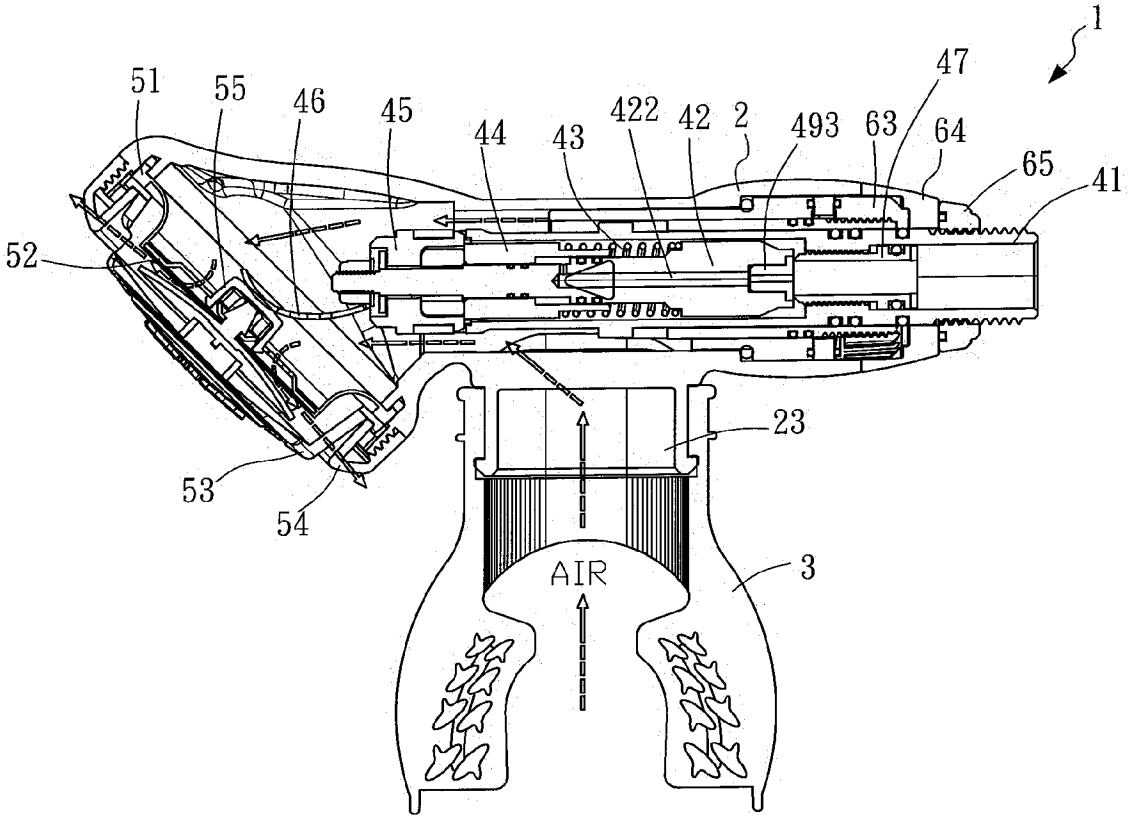

Please refer to FIG. 15A and FIG. 15B, which are schematic diagrams of the airflow directions when the second stage regulator 1 of the invention is respectively inhaled and exhaled through the mouthpiece 3. As shown in FIG. 15A, when the diver inhales through the mouthpiece 3, a negative pressure is formed at the air chamber located between the diaphragm 51 and the second insert opening 22 of the housing 2, such that the piston 42 together with the balance seat 493 are urged to move slightly toward the left and thus a gap is formed between the balance seat 493 and the left end of the orifice cap 47. Therefore, the compressed air from the air hose flows through the gap between the airflow shaft 41 and the piston 42 via the gap between the balance seat 493 and the left end of the orifice cap 47, and then, after the pressure is balanced at the air pressure balance chamber formed between the balance chamber 44 and the small air-hole 423 in the middle section of the piston 42, the air flows to the mouthpiece 3 through the air outlet 23 and enters the diver's mouth. As shown in FIG. 15B, when the diver exhales through the mouthpiece 3, a positive pressure is formed at the air chamber located between the diaphragm 51 and the second insert opening 22 of the housing 2, causing the piston 42 together with the balance seat 493 to move slightly toward the right and thereby close the gap between the balance seat 493 and the orifice cap 47. Therefore, after the diver's exhalation flows to the left air chamber through the mouthpiece 3 and the air outlet 23, and then passes through the air holes 511 of the diaphragm 51 and the exhaust valve 52, and then the exhaled air is discharged to the outside from the exhaust holes 531 on the peripheral side surface of the purge button 53.

Figure 16A:
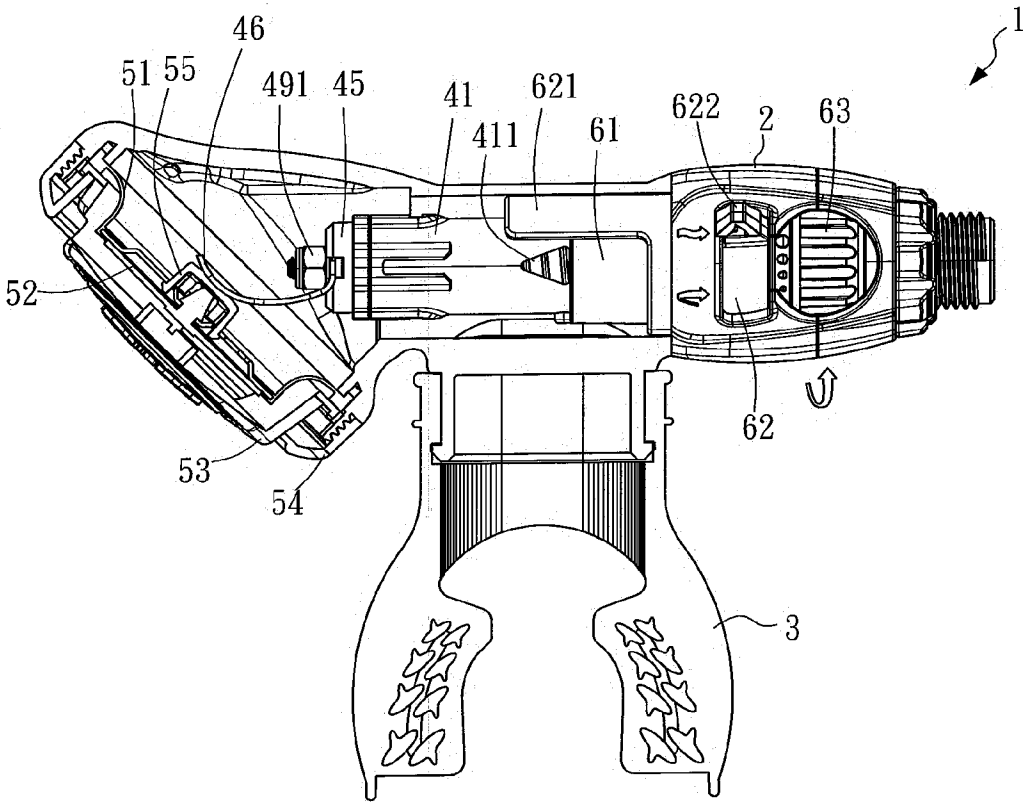
FIG. 16A and FIG. 16B are schematic diagrams of adjusting the airflow amount by operating the airflow knob in the second stage regulator of the invention.
Figure 16B:
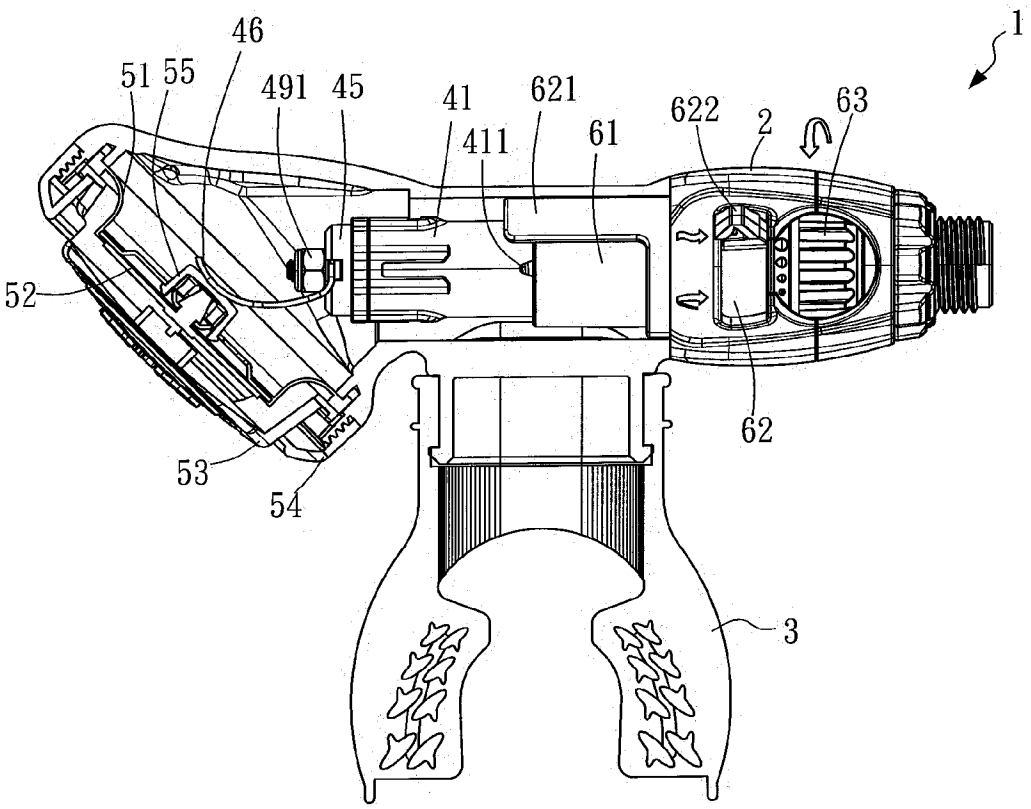

Please refer to FIG. 16A and FIG. 16B, which are schematic diagrams of adjusting the airflow amount by operating the airflow knob 63 in the second stage regulator 1 of the invention. As shown in FIG. 16A, when the diver rotates forwardly the airflow knob 63 with his/her fingers, the airflow adjust tube 61 will be driven to move toward the right, making the vent 411 of the airflow shaft 41 fully open and not blocked by the airflow adjust tube 61. Therefore, the amount of air flowing out through the vent 411 is the largest. As shown in FIG. 16B, when the airflow knob 63 is reversely rotated, the airflow adjust tube 61 will be driven to move toward the left, making the vent 411 of the airflow shaft 41 to be partially blocked by the airflow adjust tube 61, which substantially reduces the exposed size of the vent 411 (e.g., air outlet hole). Therefore, the amount of air flowing out through the vent 411 will also be correspondingly reduced.

Figure 17A:
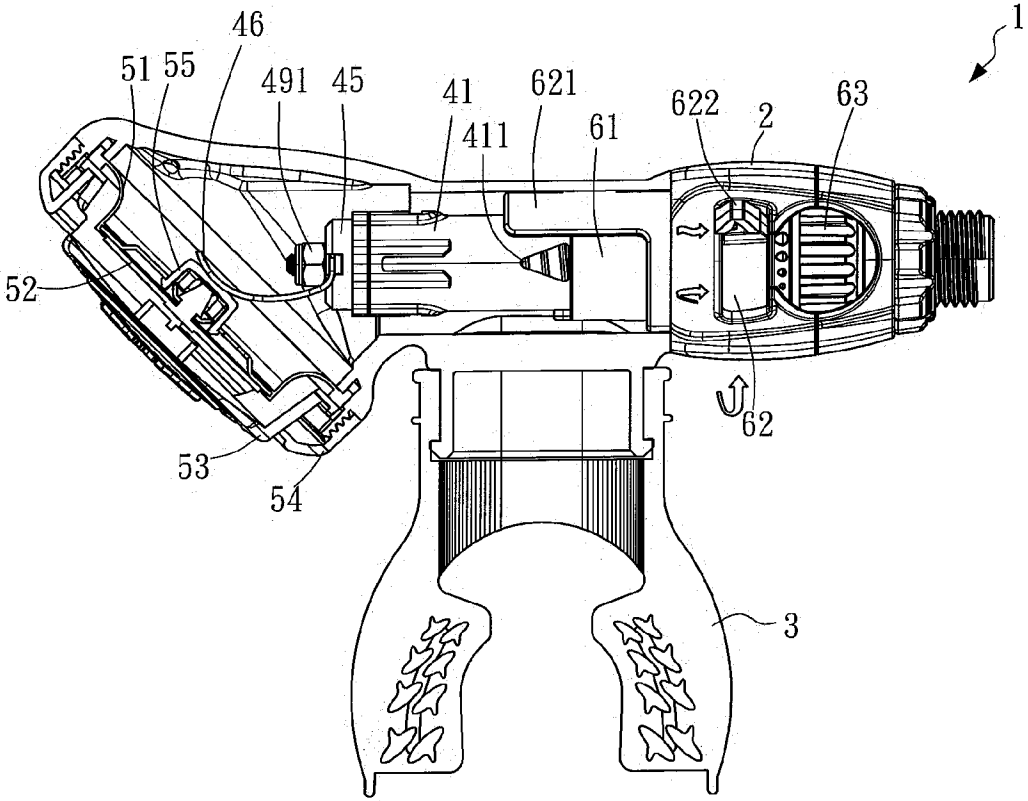
FIG. 17A and FIG. 17B are schematic diagrams of changing the direction of airflow by operating the lever bulge 622 in the second stage regulator 1 of the invention.
Figure 17B:
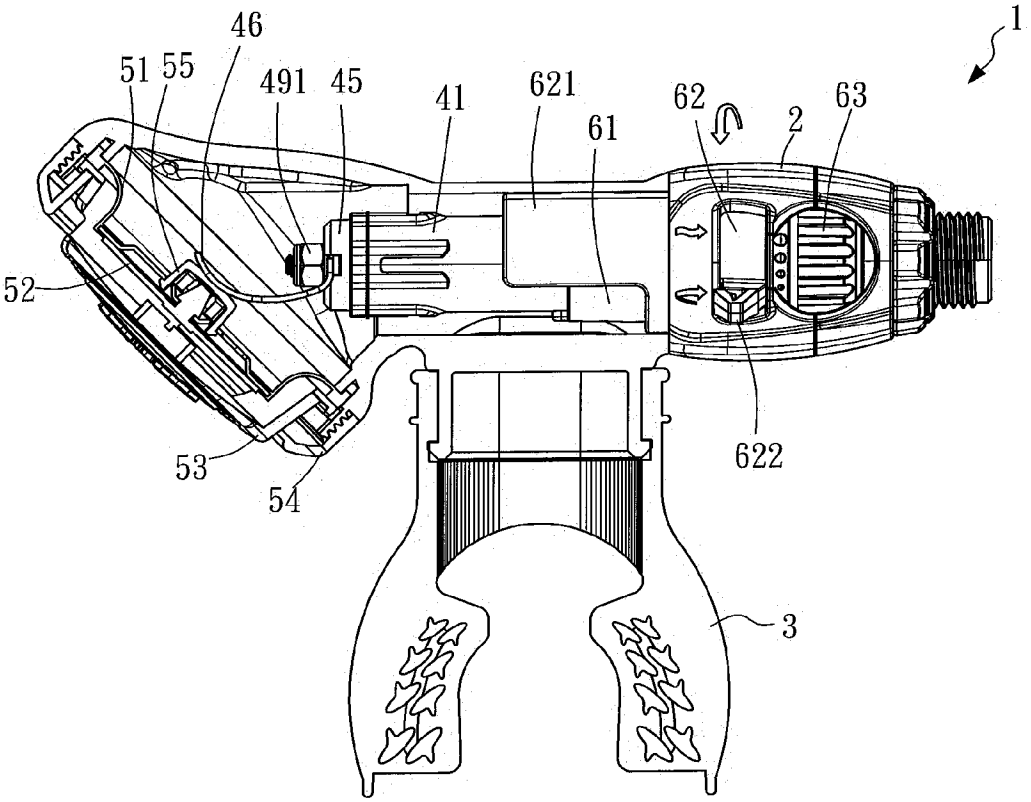

Please refer to FIG. 17A and FIG. 17B, which are schematic diagrams of changing the direction of airflow by operating the lever bulge 622 in the second stage regulator 1 of the invention. As shown in FIG. 17A, when the diver moves (pushes up) the lever bulge 622 to the upper end position with his finger, the fender 621 of the airflow adjust lever 62 will be driven to rotate forward (upward), making the vent 411 of the airflow shaft 41 completely open and not blocked by the fender 621 of the airflow adjust lever 62. Therefore, the air flowing out through the vent 411 can directly flow to the air outlet 23 and the mouthpiece 3. As shown in FIG. 17B, when the lever bulge 622 is moved (pushed down) to the lower end position of the opening 25, the fender 621 of the airflow adjust lever 62 will be driven to rotate downward and cover the vent 411 of the airflow shaft 41 (wherein there is a gap between the fender 621 and the vent 411 for air flow). Therefore, the airflow flowing out through the vent 411 will be disturbed and redirected by the fender 621, and will not directly rush to the air outlet 23 and the mouthpiece 3, so it is less likely to choke the diver.

While the present invention has been particularly shown and described with reference to a preferred embodiment, it will be understood by those skilled in the art that various changes in form and detail may be without departing from the spirit and scope of the present invention.

What is claimed is:

1. A second stage regulator for diving comprising:

a housing; an interior of the housing being provided with a T-shaped interior compartment; the T-shaped interior compartment including a central channel extending horizontally and laterally and an air outlet channel extending vertically from a middle section of the central channel; two ends of the central channel being a first insert opening and a second insert opening respectively; an air outlet being formed at an end of the air outlet channel;

a mouthpiece, assembled on the air outlet of the housing;

a decompression mechanism, arranged in the central channel of the T-shaped interior compartment of the housing; one end of the decompression mechanism being located at the first insert opening and being connectable with an air hose; another end of the decompression mechanism being located near the second insert opening; the decompression mechanism being able to control the supply of air from the air hose and guide the air to the air outlet;

an exhaust mechanism, exposed in the second insert opening of the housing and connected with said another end of the decompression mechanism; and an airflow adjustment mechanism, located in the central channel of the T-shaped interior compartment of the housing and sleeved outside the decompression mechanism; by operating the airflow adjustment mechanism, volume and direction of the air flowing toward the air outlet through the decompression mechanism can be adjusted;

wherein the decompression mechanism comprises:

an airflow shaft, the airflow shaft is an elongated hollow sleeve structure, and its right and left ends are respectively a first cylinder opening and a second cylinder opening; a threaded joint is provided on an outer surface of the first cylinder opening at the right end of the airflow shaft, and at least one guide groove is provided on an outer surface of the second cylinder opening at the left end of the airflow shaft; a vent is formed in a middle section of the airflow shaft;

a piston, inserted in the airflow shaft from the second cylinder opening; the piston has a head end with a relatively larger outer diameter on a side adjacent to the first cylinder opening, and a thread end with a relatively smaller outer diameter on another side adjacent to the second cylinder opening; a center of the piston has an air passage extending horizontally and laterally; a small air-hole is provided on the piston at a position corresponding to the vent, wherein the small air-hole is communicated with the air passage;

a spring, sleeved outside the piston and sandwiched between the piston and the airflow shaft;

a balance chamber, sleeved outside the piston and sandwiched between the piston and the airflow shaft; the spring is sandwiched between the balance chamber and the head end of the piston; by pulling the thread end of the piston, the head end can be displaced horizontally and laterally toward the balance chamber, thereby compressing the spring; when the pulling of the thread end stops, the piston will return to its original position due to an elastic force of the spring;

a lever seat, sleeved outside the piston and is assembled with the balance chamber;

a lever arm, one end of the lever arm is combined and locked with the thread end of the piston through a thread nut; by pressing the other end of the lever arm, the thread end of the piston can be pulled so that the head end is displaced horizontally and laterally toward the balance chamber;

an orifice cap, inserted in the airflow shaft through the first cylinder opening for abutting and positioning the head end of the piston; and a plurality of O-rings, respectively disposed at predetermined positions of the airflow shaft, the piston and the orifice cap, in order to provide functions of air tightness and forming an airflow passage between the airflow shaft and the piston;

wherein the airflow adjustment mechanism comprises:

a hollow airflow adjust tube, sleeved outside the airflow shaft and adjacent to the vent of the airflow shaft; the airflow adjust tube can be driven to perform horizontal lateral displacement relative to the airflow shaft, so as to partially cover the vent of the airflow shaft, or expose the vent to the outside of the airflow adjust tube;

a hollow airflow adjust lever, sleeved outside the airflow adjust tube and corresponding to the vent of the airflow shaft; the airflow adjust lever has a fender and a lever bulge; by turning the lever bulge, the airflow adjust lever can be rotated to allow the fender to block the vent of the airflow shaft, or to expose the vent outside the fender;

an airflow knob, assembled on one end of the airflow adjust tube; by rotating the airflow knob, the airflow adjust tube can be driven to perform a horizontal lateral displacement relative to the airflow shaft;

an end cap, assembled on the airflow knob; the end cap limits the airflow knob to perform only rotational movement but not horizontal and lateral movement; and a shaft nut, locked on the threaded joint at the right end of the airflow shaft;

wherein, an opening is provided in the first insert opening of the housing; the lever bulge of the airflow adjust lever is exposed in the opening of the housing;

wherein, by rotating the airflow knob to make the airflow adjust tube partially cover the vent of the airflow shaft, the function of adjusting the amount of airflow can be achieved; by turning the lever bulge of the airflow adjust lever to make the fender of the airflow adjust lever block the vent of the airflow shaft, the function of changing the direction of airflow can be achieved.

2. The second stage regulator of claim 1, wherein, when looking from the mouthpiece toward the housing of the second stage regulator, the exhaust mechanism is located on the left side of the housing and is combined with the housing at an inclined angle facing toward the left rear of the housing; such that, the second insert opening of the housing is facing toward the left rear side of the housing, while a connection end where the decompression mechanism is connectable with the air hose is located on the right side of the housing.

3. The second stage regulator of claim 1, wherein a deflector extending horizontally and laterally is arranged in the air outlet of the housing to disturb an airflow from the decompression mechanism and prevent a large amount of the air from directly rushing to the mouthpiece.

4. The second stage regulator of claim 1, wherein the exhaust mechanism comprises:

a diaphragm, made of soft material and located at the second insert opening of the housing; an air chamber is formed between the diaphragm and the second insert opening of the T-shaped interior compartment of the housing; a plurality of air holes is arranged on a surface of the diaphragm;

an exhaust valve, covering the plurality of air holes on the surface of the diaphragm; the exhaust valve is made of soft material and has a positioning plug which penetrates through a button hole in the center of the diaphragm and then protrudes out of the other side of the diaphragm away from the exhaust valve;

an exhaust valve cap, located on the other side of the diaphragm relative to the exhaust valve; the exhaust valve cap buckles inner edges of the plurality of air holes of the exhaust valve, and covers the positioning plug; the other end of the lever arm is adjacent to the exhaust valve cap;

a purge button, made of soft material and located at the second insert opening of the housing; the purge button is stacked on the diaphragm and the exhaust valve, so that the exhaust valve is located between the purge button and the diaphragm; a plurality of exhaust holes is provided on a peripheral side of the purge button; the exhaust valve cap and the diaphragm can be compressed by pressing the purge button, causing the exhaust valve cap to press the other end of the lever arm; thereby, the thread end of the piston is pulled so that the head end is displaced horizontally and laterally toward the balance chamber and compresses the spring; and a cover retainer, assembled on the second insert opening of the housing in such a manner that, the diaphragm, the exhaust valve, and the purge button are clamped and positioned on the second insert opening of the housing by means of the cover retainer.

* * * * *